US005693156A

United States Patent [19]

Berczik

[11] Patent Number: 5,693,156

[45] Date of Patent: Dec. 2, 1997

[54] OXIDATION RESISTANT MOLYBDENUM ALLOY

[75] Inventor: Douglas M. Berczik, North Palm Beach, Fla.

[73] Assignee: United Technologies Corporation, East Hartford, Conn.

[21] Appl. No.: 373,945

[22] Filed: Jan. 17, 1995

Related U.S. Application Data

[63] Continuation-in-part of Ser. No. 170,933, Dec. 21, 1993, abandoned.

[51] Int. Cl.[6] ..... C22C 27/04

[52] U.S. Cl. ..... 148/407; 148/423; 420/429

[58] Field of Search ..... 75/238, 244, 254; 148/407, 423; 501/96; 420/429

[56] References Cited

U.S. PATENT DOCUMENTS

| | | |
|---|---|---|
| 2,399,747 | 5/1946 | Linz . |
| 2,665,474 | 1/1954 | Beidler et al. . |
| 3,013,329 | 12/1961 | Fraser . |
| 3,110,589 | 11/1963 | Bechtold . |
| 3,690,686 | 9/1972 | Prasse et al. . |
| 3,720,990 | 3/1973 | Larsen . |
| 3,841,846 | 10/1974 | Larsen et al. . |
| 4,594,104 | 6/1986 | Reybould . |
| 4,949,836 | 8/1990 | Schostek . |

FOREIGN PATENT DOCUMENTS

| | | |
|---|---|---|
| 106973 | 8/1927 | Austria . |
| 618954 | 4/1961 | Canada . |
| WO 85/03953 | 9/1985 | WIPO . |

OTHER PUBLICATIONS

Nowotny, H. et al. Monat shefte Fur Chemie 88, 180, "Untersuchengen in den Dreistoffsystemen: Molybdan–Silizium–Bor, Wolfram–Silizium–Bor und in dem System: VSi2–TaSi2", pp. 180–190, with translation, 1957.

Parthe, E. Acta Crys. vol. 10, "Contributions to Nowotny phases", pp. 768–769, 1957.

Quakerriaat, J et al. High Temperatures–High Pressures, "Lattice dimensions of low–rate metalloid–stabilized Ti5Si3" vol. 6, pp. 515–517, 1974.

J.A. Shields, Jr., *Molybdenum and Its Alloys,* Advanced Materials & Processes, Oct., 1992.

*Primary Examiner*—David A. Simmons
*Assistant Examiner*—Margery S. Phipps
*Attorney, Agent, or Firm*—Reid & Priest L.L.P.

[57] ABSTRACT

Molybdenum alloys are provided with enhanced oxidation resistance. The alloys are prepared by the addition of silicon and boron in amounts defined by the area of a ternary system phase diagram bounded by the points Mo-1.0% Si-0.5% B, Mo-1.0% Si-4.0% B, Mo-4.5% Si-0.5% B, and Mo-4.5% Si-4.0 B. The resultant alloys have mechanical properties similar to other high temperature molybdenum alloys while possessing a greatly enhanced resistance to oxidation at high temperature. The alloys are composed of a matrix of body centered cubic molybdenum surrounding discrete intermetallic phases. A variety of alloying elements are added to the base composition to modify the alloy properties.

20 Claims, 1 Drawing Sheet

OXIDATION RESISTANT MOLYBDENUM ALLOY

This is a continuation-in-part of U.S. patent application Ser. No. 08/170,933, filed Dec. 21, 1993, now abandoned.

FIELD OF THE INVENTION

The present invention relates to molybdenum alloys that have been made oxidation resistant by the addition of silicon and boron.

INTRODUCTION

Molybdenum metal is an attractive material for use in jet engines and other high temperature applications because it exhibits excellent strength at high temperature. In practice, however, the utility of molybdenum has been limited by its susceptibility to oxidation. When molybdenum or molybdenum alloys are exposed to oxygen at temperatures in excess of about 1000° F., the molybdenum is oxidized to molybdenum trioxide and vaporized from the surface; resulting in shrinkage and eventually disintegration of the molybdenum or molybdenum alloy article. Most previously disclosed methods of preventing oxidation of molybdenum at high temperature in oxidizing environments (such as air) have required a coating to be applied to the molybdenum alloy. Applied coatings are sometimes undesirable due to factors such as: poor adhesion, the need for extra manufacturing steps, and cost. Furthermore, damage to the coating can result in rapid oxidation of the underlying molybdenum alloy. Thus, there is a need for molybdenum alloys which possess a combination of good strength and enhanced oxidation resistance at high temperature. There is a corresponding need for methods of making these alloys.

OBJECTS OF THE INVENTION

Thus, it is an object of the present invention to provide molybdenum alloys which exhibit good strength and enhanced oxidation resistance at high temperature.

It is a further object of the present invention to provide methods of making molybdenum alloys, and articles made therefrom, which exhibit good strength and enhanced oxidation resistance at high temperatures.

It is yet another object of the present invention to provide a method of enhancing the oxidation resistance of molybdenum and molybdenum alloys.

SUMMARY OF THE INVENTION

The molybdenum alloys of the present invention are composed of a matrix of body-centered cubic (BCC) molybdenum and dispersed intermetallic phases wherein the composition of the alloys are defined by the points of a phase diagram for the ternary system metal-1.0% Si-0.5% B, metal-1.0% Si-4.0% B, metal-4.5% Si-0.5% B and metal-4.5% Si-4.0% B where metal is molybdenum or a molybdenum alloy. Smaller amounts of silicon and boron will not provide adequate oxidation resistance; larger amounts will embrittle the alloys. All percentages (%) disclosed herein refer to weight percent unless otherwise specified. In the foregoing composition ranges, the molybdenum metal component may contain one or more of the following elemental additions in replacement of an equivalent amount of molybdenum:

| ELEMENT | RANGE IN WEIGHT % OF THE FINAL ALLOY | PREFERRED RANGE |
|---|---|---|
| C | 0.01 to 1.0 | 0.03 to 0.3 |
| Ti | 0.1 to 15.0 | 0.3 to 10.0 |
| Hf | 0.1 to 10.0 | 0.3 to 3.0 |
| Zr | 0.1 to 10.0 | 0.3 to 3.0 |
| W | 0.1 to 20.0 | 0.3 to 3.0 |
| Re | 0.1 to 45.0 | 2.0 to 10.0 |
| Al | 0.1 to 5.0 | 0.5 to 2.0 |
| Cr | 0.1 to 5.0 | 0.5 to 2.0 |
| V | 0.1 to 10.0 | 0.3 to 5.0 |
| Nb | 0.1 to 2.0 | 0.3 to 1.0 |
| Ta | 0.1 to 2.0 | 0.3 to 1.0 |

When the alloys of the present invention are exposed to an oxidizing environment at temperatures greater than 1000° F., the material will produce a volatile molybdenum oxide in the same manner as conventional molybdenum alloys. Unlike conventional alloys, however, oxidation of alloys of the present invention produces build-up of a borosilicate layer at the metal surface that will eventually shut off the bulk flow of oxygen (see FIG. 1). After a borosilicate layer is built up, oxidation is controlled by diffusion of oxygen through the borosilicate and will, therefore, proceed at a much slower rate.

In certain preferred embodiments, it is advantageous to add a reactive element such as titanium, zirconium, hafnium, and/or aluminum to the alloy to: (1) promote wetting of the borosilicate layer once it has formed, (2) raise the melting point of the borosilicate, and (3) form a more refractory oxide layer below the initial borosilicate layer further impeding oxygen transport to the molybdenum matrix. The addition of such elements is particularly advantageous for alloys that are intended to be used at high temperatures (i.e., about 2000° F.). In some embodiments, it is advantageous to add carbon to the alloy in order to produce small amounts (less than 2.5 volume %) of carbide to strengthen the alloy. The alloys of the present invention preferably contain 10 to 70 volume % molybdenum borosilicide ($Mo_3SiB_2$), less than 20 volume % molybdenum boride ($Mo_2B$), and less than 20 volume % molybdenum silicide ($Mo_5Si_3$ and/or $Mo_3Si$). In a still more preferred embodiment, the alloys of the present invention comprise less than 2.5 volume % carbide and less than 3 volume % of non-BCC molybdenum phases, other than the carbide, silicide, and boride phases discussed above. Preferred alloys of the present invention are formulated to exhibit oxidation resistance such that articles composed of these alloys lose less than about 0.01" (about 0.25 mm) in thickness after exposure to air for two hours at the maximum use temperature of the article. The maximum use temperature of these articles is typically between 1500° F. and 2500° F. It is contemplated that the alloys of the present invention be formulated for the best overall combination of oxidation resistance and mechanical properties for each article's particular requirements.

The alloys of the present invention can be produced through a variety of methods including, but not limited powder processing (prealloyed powder, blended powder, blended elemental powder, etc.), and deposition (physical, vapor deposition, chemical vapor deposition, etc.). Powders of the alloys of the present invention can be consolidated by methods including, but not limited to: extrusion, hot pressing, hot isostatic pressing, sintering, hot vacuum compaction, etc. After consolidation, the alloys can be thermal-mechanically processed by methods used conventionally on molybdenum alloys.

While the alloys of the present invention may be used in less demanding conditions, these alloys are particularly desirable for use in situations requiring both good strength and good oxidation resistance at temperatures in excess of 1000° F. Particular applications include, but are not limited to, jet engine parts such as turbine blades, vanes, seals, and combustors.

DETAILED DESCRIPTION OF THE INVENTION

Figure 1:
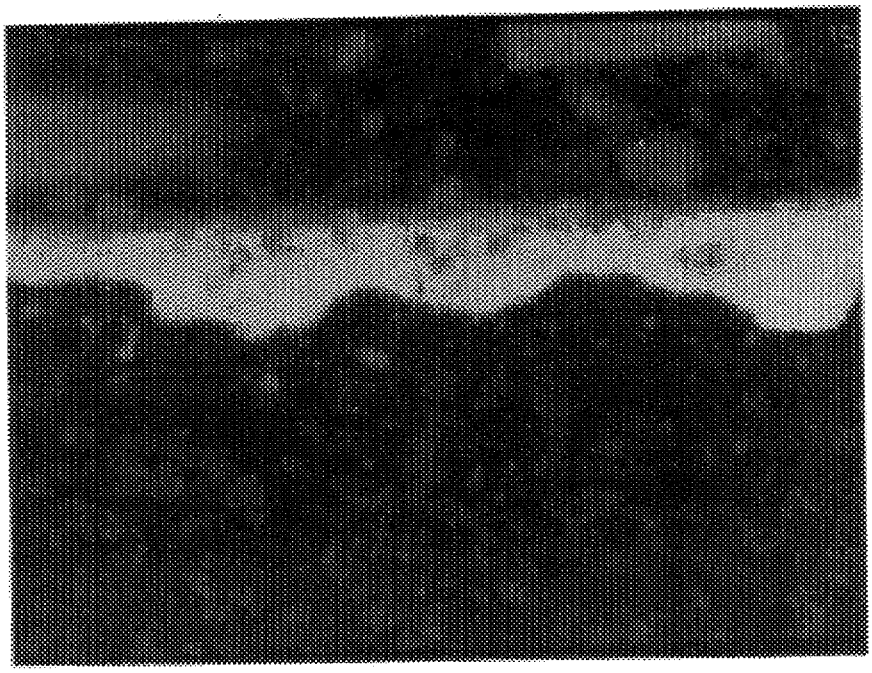
FIG. 1 shows an X-ray map of silica scale (white area) produced on the alloy Mo-0.3% Hf-2.0% Si-1.0% B by oxidation in air at 2000° F. for two hours. The magnification is 1000× so that 1 cm is equal to 10 microns.

Alloys of the present invention are made by combining elements in proportion to the compositional points defined by the points of a phase diagram for the ternary system metal-1.0% Si-0.5% B, metal-1.0% Si-4.0% B, metal-4.5% Si-0.5% B, and metal-4.5 % Si-4.0% B, wherein the metal is greater than 50% molybdenum.

The intermetallic phases of the alloy of the present invention are brittle. Therefore, in order to obtain ductile alloys, the material must be processed so that there is a matrix of ductile BCC molybdenum surrounding discrete particles of intermetallic phase. This structure is obtained, in preferable embodiments of the present invention by: 1) blending molybdenum powder with either a prealloyed intermetallic powder (such as molybdenum borosilicide) or boron and silicon powder, followed by consolidating the powder at a temperature below the melting temperature of the alloy; or 2) rapidly solidifying a melt containing molybdenum, silicon and boron, followed by consolidating the rapidly solidified material at a temperature below the melting temperature. The latter process is more expensive but it produces a material having a finer, more processable microstructure.

In order to obtain desired shape, strength and hardness, alloys of the present invention can be processed in the same manner as other high strength molybdenum alloys. Preferred alloys of the present invention can not be shaped by recasting and slow solidification since slow solidification forms excessively large dispersoids and, as a result, embrittled alloys.

In the most preferable method of making alloys of the present invention, elemental molybdenum, silicon and boron, in the portions defined above, are combined in a melt. Alloy from the melt is rapidly solidified into a fine powder using an atomization device based on U.S. Pat. No. 4,207,040. The device from this patent was modified by the substitution of a bottom pour 250 kilowatt plasma arc melter for the induction heated crucible. The resultant powder is screened to minus 80 mesh. This powder is loaded into a molybdenum extrusion can and then evacuated. The material is then given a pre-extrusion heat treatment of 3200° F. for 2 hours and then is extruded at a cross-sectional ratio of 6 to 1 at a temperature of 2750° F. The extrusion is then swaged 50% in 5% increments at 2500° F. The molybdenum can is then removed and the remaining material is then swaged down to the desired size at temperatures of 2300° to 2500° F. All heat treatments and pre-heating should be done in an inert atmosphere, in vacuo, or in hydrogen.

Other elements can replace some of the molybdenum in alloys of the present invention. The use of titanium, zirconium, hafnium and/or aluminum in the alloys of the present invention promotes wetting of the metal surface by the oxide and increases the melting point of the oxide. Larger additions (i.e. 0.3% to about 10% ) of these elements creates a refractory oxide layer under the initial borosilicate layer. The addition of titanium is especially preferred for this use.

Because elements such as titanium, zirconium, hafnium and aluminum can have a small deleterious effect on oxidation resistance at temperatures below about 1800° F.; the addition of these elements is undesirable for some low temperature applications.

The tensile strength of the alloys of the present invention can be increased by the addition of solid solution strengthening agents. Additions of titanium, hafnium, zirconium, chromium, tungsten, vanadium and rhenium strengthen the molybdenum matrix. In addition to strengthening the material, rhenium can also be added to lower the ductile\brittle transition temperature of the BCC matrix.

Since titanium, zirconium, and hafnium are potent silicide and boride formers, these elements can be added to improve the mechanical properties of the alloys by increasing the fracture strength of the intermetallic phases. In some embodiments, the intermetallic phases are strengthened by the use of carbon as an alloying addition.

In certain, preferred embodiments, alloys of the present invention are additionally strengthened through solutioning and aging. In these alloys small amounts of silicon and/or carbon can be taken into solution in the BCC matrix by heating the alloy to over 2800° F. A fine dispersion of either silicides or carbides can then be produced in the alloy by either controlled cooling of the material, or by cooling it fast enough to keep the silicon and/or carbon in solution and then precipitating silicides and/or carbides by aging the material between 2700° F. and 2300° F. Tungsten and rhenium decrease the solubility of silicon in the alloy and when added in small amounts (i.e. about 0.1–3.0% ) improve the stability of any fine silicides present. In alloys with an insufficient amount of silicon present for an aging response, vanadium may be added to increase the solubility of silicon in the alloy. The elements titanium, zirconium, and hafnium may be added to improve the aging response by promoting the formation of alloy carbides. In a preferred embodiment, the silicide or carbide fine dispersion particles consist essentially of particles having diameters between 10 nm and 1 micron. In a more preferred embodiment, these fine dispersion particles are spaced apart by 0.1 to 10 microns.

In preferred embodiments, alloys of the present invention are composed of long grains having an aspect ratio of greater than 6 to 1.

Phases in alloys of the present invention were characterized by scanning electron microscope—energy dispersive x-ray analysis (SEM-EDX) and x-ray back scattering. In alloys containing only molybdenum, silicon and boron, the stable phases are $Mo_5SiB_2$, $Mo_2B$, and $Mo_3Si$. Alloys containing more than about 2% of additive elements such as titanium, zirconium or hafnium may have alloyed $Mo_5Si_3$ present either in addition to or in place of $Mo_3Si$. In a preferred embodiment, the molybdenum boride, silicide and borosilicide dispersion particles consist essentially of particles having diameters between 10 microns and 250 microns.

OXIDATION RESISTANCE

Figure 2:
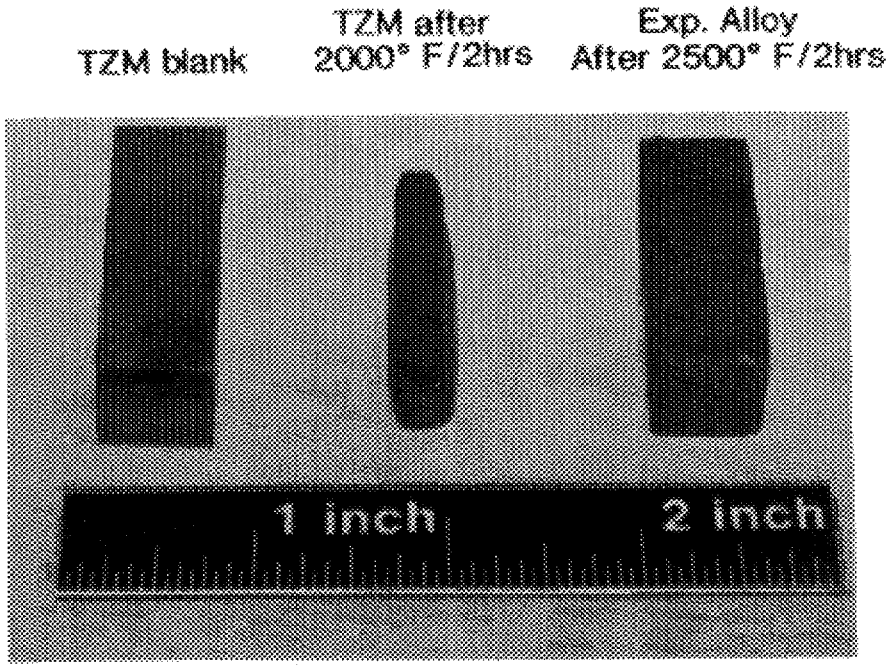
FIG. 2 shows the comparison of the oxidation resistance of an alloy of the present invention (Mo-6.0% Ti-2.2% Si-1.1% B) and a conventional (Mo-0.5 % Ti-0.08% Zr-0.03% C, TZM) alloy molybdenum which have been exposed to air for two hours at 2500° F. and 2000° F., respectively.

A series of tests were conducted that demonstrated the molybdenum alloys of the present invention to have a far greater oxidation resistance than previously known molybdenum alloys. All of the tests were performed using small arc castings made in an inert atmosphere from metal powders. In a comparative test, illustrated in FIG. 2, TZM, a commercially available molybdenum alloy, lost approximately 2.5 mils per minute in an air furnace at 2000° F. In comparison, an alloy of the present invention, having the composition Mo-6.0% Ti-2.6% Si-1.1% B lost approximately 2 mils in two hours in an air furnace at 2500° F. and formed an oxide layer that would greatly retard further oxidation.

A set of oxidation tests were performed that demonstrated the effects of various amounts of silicon and boron in molybdenum. These tests were conducted in an air furnace at 2000° F. for 1 hour and used identically prepared samples consisting only of molybdenum, silicon and boron. The results of this test are shown in Table 1.

TABLE 1

Oxidation Rates of Various Molybdenum Alloys at 2000° F.

| Si | B | oxidation rate (mils/min) |
|---|---|---|
| 1.0 | 0.5 | 0.7 |
| 1.0 | 4.0 | 0.07 |
| 4.5 | 4.0 | 0.02 |
| 4.5 | 0.5 | 0.5 |
| 0.5 | 0.5 | 1.6 |
| 1.0 | 0 | 2.0 |
| 5.0 | 0 | 1.3 |
| 1.0 | 7.0 | 0.05 |
| 4.5 | 7.0 | 0.05 |

The oxidation rate of 0.7 mils per minute is one third that of TZM and represents the practical limit for a material that could survive in a coated condition in a short time non-manrated jet engine application where the use time of the material would be on the order of 15 minutes. As shown from the test data, the addition of 0.5% B results in significantly better oxidation resistance than silicon alone. More importantly, the Mo-1.0% Si material did not form a protective oxide and the Mo-5.0% Si formed a voluminous, porous oxide with extremely poor adherence to the base metal. An alloy containing 0.5% B and only 0.5% Si exhibited intermittent formation of a non-protective oxide and twice the oxidation rate of the alloy containing 0.5% B and 1.0% Si. The materials containing excessive boron, Mo-1.0% Si-7.0% B and Mo-4.5% Si-7.0% B, demonstrated good oxidation rates but produced highly liquid oxides which flowed over and attacked the material the specimens were placed on. The oxides would be subject to degradation by any flowing media such as air passing over the material and would be easily removed by physical contact.

In another set of tests approximately 200 alloy compositions were made up of small arc castings and tested for oxidation resistance. These oxidation tests were conducted at temperatures of 1500° F., 2000° F. and 2500° F. The tests were done for 2 hours in an air furnace. The specimens were rectangles approximately ¼×⅜×¾ inches long. It was found that as the amount of silicon and boron increased, the amount of intermetallic present also increased, and the better the oxidation resistance became. However, increasing amounts of silicon and boron also made the material difficult to process for useful mechanical properties. At 2% silicon and 1% boron there is approximately 30 to 35 volume % intermetallic in the material. Additions of titanium, zirconium and hafnium improve the oxidation resistance of the material at 2000° F. without causing an increase in the amount of intermetallic. These elements caused a slight but acceptable decrease in the oxidation resistance at 1500° F. They caused a significant increase in the oxidation resistance at 2500° F.

The following compositions are examples of alloys that were found to be highly oxidation resistant at 1500, 2000, and 2500° F.: Mo-2.0% Ti-2.0% Si-1.0% B; Mo-2.0% Ti-2.0% Si-1.0% B-0.25% Al; Mo-8.0% Ti-2.0% Si-1.0% B; Mo-0.3% Hf-2.0% Si-1.0% B; Mo-1.0% Hf-2.0% Si-1.0% B; Mo-0.2% Zr-2.0% Si-1.0% B; and Mo-6.0% Ti-2.2% Si-1.1% B. Mo-6.0% Ti-2.2% Si-1.1% B showed particularly excellent oxidation resistance at 2000° and 2500° F.

STRENGTH

The tensile properties of Mo-0.3% Hf-2.0% Si-1.0% B are shown in Table 2. The alloy used in testing was prepared by rapid solidification from the melt followed by extrusion as described above with reference to the most preferred embodiment. Tensile strength testing was conducted on bars 0.152" in diameter, 1" long with threaded grips and 0.25" radius shoulders. For comparison, the yield strength of TZM at 2000° F. is 70 ksi and the yield strength of a single crystal nickel superalloy at 2000° F. is 40 ksi. For a review of molybdenum alloys and their strengths; see J. A. Shields, "Molybdenum and its Alloys," *Advanced Materials & Processes*, pp. 28–36, October 1992.

TABLE 2

Tensile Properties of Mo—.3% Hf—2% Si—1% B.

| Temperature | Yield Strength | Ultimate Strength | % El | % RA |
|---|---|---|---|---|
| RT | 115.3 | 115.7 | .2 | 0 |
| 1000° F. | 112.5 | 140.2 | 2.5 | 0.8 |
| 1500° F. | 103.4 | 148.0 | 2.6 | 1.6 |
| 2000° F. | 68.4 | 77.0 | 21.5 | 29.4 |
| 2300° F. | 36.3 | 43.3 | 28.2 | 36.0 |
| 2500° F. | 24.6 | 29.5 | 31.6 | 39.8 |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

I claim:

1. Molybdenum alloys composed of a matrix of body centered cubic molybdenum surrounding discrete particles of intermetallic phases wherein said alloys consist essentially of a composition defined by the area described by the compositional points of the phase diagram for a ternary system: metal-1.0% Si-0.5% B, metal-1.0% Si-4.0% B, metal-4.5% Si-0.5% B, and metal-4.5% Si-4.0% B; wherein percentages are weight % and wherein said metal consists essentially of molybdenum as the major component.

2. The molybdenum alloys of claim 1 comprising 10 to 70 volume % molybdenum borosilicide, less than 20 volume % molybdenum boride, and less than 20 volume % molybdenum silicide.

3. The molybdenum alloys of claim 2 further comprising up to 2.5 volume % carbides.

4. The molybdenum alloys of claim 3 having a resistance to oxidation such that said alloys lose less than about 0.01"

of thickness from each surface of said alloy when heated to 2000° F. in air for 2 hours.

5. The molybdenum alloys of claim 4 having a yield strength of greater than 60 ksi at 2000° F.; wherein said yield strength is measured on a round specimen formulated and tested per ASTM E21-79.

6. The molybdenum alloys of claim 1 consisting essentially of:

| | |
|---|---|
| Mo | 50–98.5% |
| C | 0.0–1.0% |
| [Ti | 0.0–15.0% |
| Hf | 0.0–10.0%] |
| Ti | 0.0–15.0% |
| Hf | 0.0–10.0% |
| Zr | 0.0–10.0% |
| W | 0.0–20.0% |
| Re | 0.0–45.0% |
| Al | 0.0–5.0% |
| Cr | 0.0–5.0% |
| V | 0.0–10.0% |
| Nb | 0.0–2.0% |
| Ta | 0.0–2.0% |
| B | 0.5–4.0% |
| Si | 1.0–4.5% |

wherein % is weight %.

7. The molybdenum alloys of claim 6 comprising at least one element in the stated quantity selected from the group consisting of:

| | |
|---|---|
| C | 0.01–1.0% |
| [Ti | 0.1–15.0% |
| Hf | 0.1–10.0%] |
| Ti | 0.1–15.0% |
| Hf | 0.1–10.0% |
| Zr | 0.1–10.0% |
| W | 0.1–20.0% |
| Re | 0.1–45.0% |
| Al | 0.1–5.0% |
| Cr | 0.1–5.0% |
| V | 0.1–10.0% |
| Nb | 0.1–2.0% |
| Ta | 0.1–2.0% |

wherein % is weight %.

8. The molybdenum alloys of claim 7 comprising at least one element selected from the group consisting of:

| | |
|---|---|
| C | 0.03–0.3% |
| Ti | 0.3–10.0% |
| Hf | 0.3–3.0% |
| Zr | 0.3–3.0% |
| W | 0.3–3.0% |
| Re | 2.0–10.0% |
| Al | 0.5–2.0% |

-continued

| | |
|---|---|
| Cr | 0.5–2.0% |
| V | 0.3–5.0% |
| Nb | 0.3–1.0% |
| Ta | 0.3–1.0% |

wherein % is weight %.

9. The molybdenum alloys of claim 8 having a resistance to oxidation such that said alloys lose less than about 0.01" of thickness from each surface of said alloy when heated to 2000° F. in air for 2 hours.

10. The molybdenum alloys of claim 9 having a yield strength of greater than 60 ksi at 2000° F.; wherein said yield strength is measured on a round specimen formulated and tested per ASTM E21-79.

11. The molybdenum alloys of claim 7 having a resistance to oxidation such that said alloys lose less than about 0.01" in thickness from each surface of said alloy when heated to about 2500° F. in air for 2 hours.

12. The molybdenum alloys of claim 7 comprising 10 to 70 volume % molybdenum borosilicide, less than 20 volume % molybdenum boride, and less than 20 volume % molybdenum silicide.

13. Molybdenum alloys composed of a matrix of body centered cubic molybdenum surrounding discrete particles of intermetallic phases wherein said alloys consist essentially of a composition defined by the area described by the compositional points of the phase diagram for a ternary system: metal-1.0% Si-0.5% B, metal-1.0% Si-4.0% B, metal-4.5% Si-0.5% B, and metal-4.5% Si-4.0% B; wherein percentages are weight % and wherein said metal consists essentially of molybdenum as the major component and further wherein said alloys have a yield strength of greater than 60 ksi at 2000° F. as measured per ASTM E21-79.

14. The alloys of claim 1 in the form of a jet engine part.

15. The alloys of claim 1 wherein said alloys are made by consolidating a rapidly solidified powder at a temperature below the melting temperature of molybdenum.

16. The alloys of claim 15 wherein said alloys are in the form of a jet engine part.

17. The alloys of claim 15 wherein the consolidating step is selected from the group consisting of extrusion, hot pressing, hot isostatic pressing and hot vacuum compaction.

18. The alloys of claim 1 comprising at least 89 weight % Mo.

19. The alloys of claim 1 wherein said intermetallic phases consist essentially of molybdenum borosilicide, molybdenum boride and molybdenum silicide.

20. The alloys of claim 1 wherein said intermetallic phases occupy about 30 to 35 volume %.

* * * * *